US010625828B1

(12) United States Patent
Sharon

(10) Patent No.: US 10,625,828 B1
(45) Date of Patent: Apr. 21, 2020

(54) SYSTEM FOR ATTACHMENT OF PORTABLE MOTOR MODULE TO SURFBOARDS

(71) Applicant: Shay Sharon, Ashdod (IL)

(72) Inventor: Shay Sharon, Ashdod (IL)

( * ) Notice: Subject to any disclaimer, the term of this patent is extended or adjusted under 35 U.S.C. 154(b) by 62 days.

(21) Appl. No.: 15/294,736

(22) Filed: Oct. 16, 2016

Related U.S. Application Data

(60) Provisional application No. 62/242,325, filed on Oct. 16, 2015.

(51) Int. Cl.
*B63B 35/79* (2006.01)
*B63B 35/85* (2006.01)

(52) U.S. Cl.
CPC ..... *B63B 35/7943* (2013.01); *B63B 35/85* (2013.01)

(58) Field of Classification Search
CPC . B63B 35/79; B63B 35/7906; B63B 35/7926; B63B 35/7943
USPC ..... 441/65, 74, 79; 114/55.56
See application file for complete search history.

(56) References Cited

U.S. PATENT DOCUMENTS 4,789,368 A * 12/1988 D'Onofrio ..... B63B 35/7933 441/74
7,182,037 B2 * 2/2007 Otobe ..... B63B 35/795 441/74
8,636,552 B2 * 1/2014 Braden ..... B63B 35/7943 441/74
2003/0167991 A1 * 9/2003 Namanny ..... B63B 35/7926 441/74
2003/0227658 A1 * 12/2003 Thomas ..... G01B 9/021 359/35
2006/0197094 A1 * 9/2006 Sugawara ..... H01L 33/20 257/79
2014/0197288 A1 * 7/2014 Yang ..... F16B 47/006 248/205.9

* cited by examiner

*Primary Examiner* — Lars A Olson

(57) ABSTRACT

A universal attachment system wherein harnesses are provided which can be installed on a broad variety of surfboards, other boards and light watercrafts not requiring any permanent fixtures or permanent special features on said boards and are suitable for the attachment under-board of a motor module. The attachment straps are equipped with tightening devices for example ratchets and tension measuring means such as for example piezo-luminescent coating. Either the whole harness or the motor module alone are provided with the quick release means either mechanical or magnetic. The detached motor module is equipped with a capability of homing in to the radio control transmitter or traveling to a designated GPS location.

7 Claims, 5 Drawing Sheets

VIEW A

BOTTOM VIEW

VIEW A-A

SYSTEM FOR ATTACHMENT OF PORTABLE MOTOR MODULE TO SURFBOARDS

RELATIONSHIP TO OTHER APPLICATIONS

The present patent application is related pursuant to the concept of the unity of an invention to U.S. provisional patent application 62/242,325 and claims benefit of the filing date of said provisional application.

1. FIELD OF THE INVENTION

This invention relates to attachment systems for installing a portable motor module on surfboards and other swimming boards and particularly to a universal removable attachment harness system adjustable for use with various surfboards, other boards and light watercrafts.

2. DESCRIPTION OF THE PRIOR ART

There are many examples of developing motorized surfboards and other types of boards intended to spare the surfer the often strenuous effort to swim into a position where a wave may be caught. The early development in this field involved the use of outboard motors such as for example in the U.S. Pat. No. 3,040,697 the outboard motor was installed in the middle of the board where the board would have to be purposely made including the opening for the outboard motor and the inverted channel in said board's bottom surface leading to and from the propeller. Another design was presented in the U.S. Pat. No. 3,158,882A—there the outboard motor was put into a cavity in the board and was designed to be removable. When it was removed the cavity was to be filled with a filler. Again the board needed to be purposely made for that. In both cases the outboard motor certainly could not be submerged or even covered by a wave which is highly impractical for the conditions of the surfing sport. Further development is reflected in the patent U.S. Pat. No. 4,020,782A where an electric motor was enclosed into an elongated buoyant float which could be moved along the tracks downward into the water or back up and out of the water. The buoyancy of the float helped preserve the boards balance and stability. This design however still requires that the board be specially made and the float is an integral part of it. The US patent application offered a design where the drive unit unfolds onto the bottom surface of the board through the opening doors and then retracts into the board with the doors closing flush with the surface, when no longer needed. Again the board must be specially made and the motor unit is not portable but rather is an integral part of it. The patent EP0350599 offers a new feature; the ability to install the motor without modifying the board in any way, but it requires a board with a dead end hole for the mast and using the holes for the fins which therefore needed to be removed. The resulting structure was suitable for traveling on rivers, but is not suitable for the surfing sport. The U.S. Pat. No. 8,398,446 B2 provides the motorized cassette which is readily inserted or removed into a cavity in the board and when removed a storage cassette can be put into its place this design once again requires a specially made board with a cavity for said cassettes, so while the motor is thus portable it can only be installed on the same board or another board of the same type with the same shape and size of the cavity. The portable motor module which comes with a universal attachment system and can be used with a broad variety of boards of different types and makes is not findable in the prior art. Likewise the ability to release the motor module and to have it travel homing in to control unit or to a designated GPS location is not described in the prior art.

3. OBJECTS AND ADVANTAGES

One object is to provide the attachment harness that can be adjusted to be mounted on a variety of swimming boards without requiring any designed for that purpose permanent fixtures on said boards.

Another object is to provide the attachment harness that can be easily detached to slip away from the board while the floating motor module remains affixed to said harness. Another object is to provide the attachment harness from which the floating motor module can be easily detached to slip away from the board while said harness remains in place on the board.

Another object is to provide the system controlling the movement of the motor module and its retrieval.

Another object is to equip said harness with means of controlling the tension of straps that it comprises.

4. BRIEF DESCRIPTION OF THE DRAWINGS

5. DESCRIPTION OF THE PREFERRED EMBODIMENTS

Figure 1:
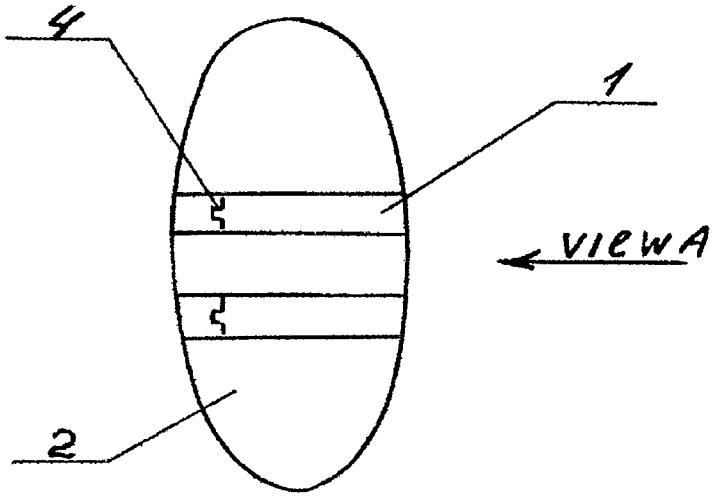
FIG. 1 is a top view of a surfboard with double strap harness going across said board's axis.
Figure 2:
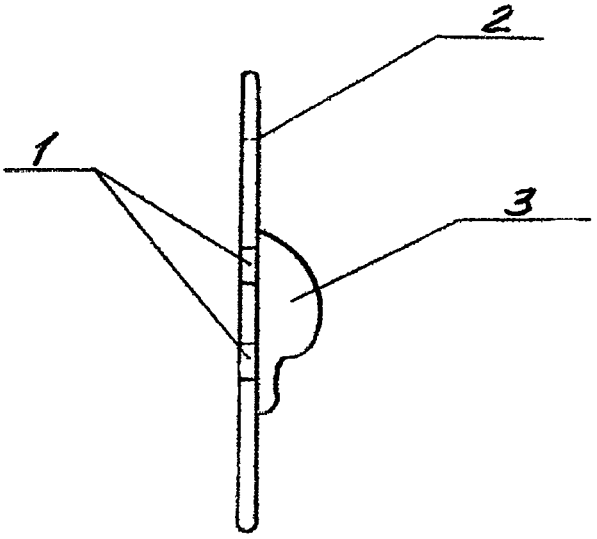
FIG. 2 is a side view of a surfboard with a double strap harness.
Figure 4:
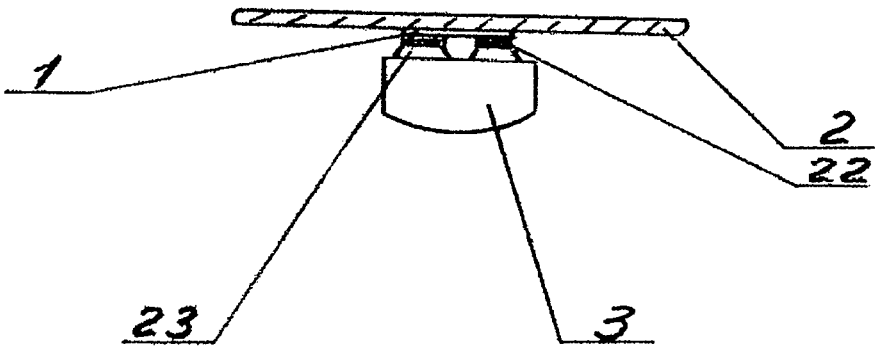
FIG. 4 is a rear view of a surfboard with harness with motor module affixed thereto.
Figure 5:
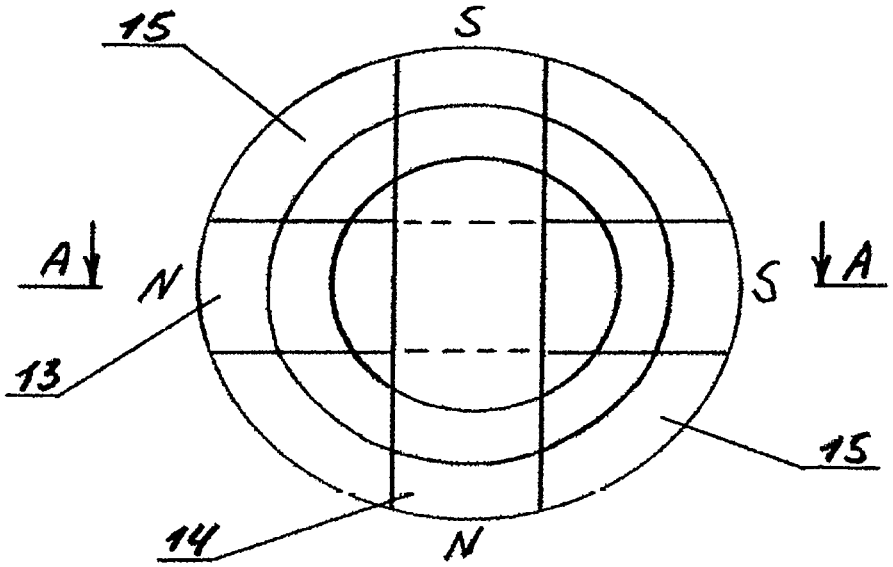
FIG. 5 is a top view of motor module's magnetic attachment base.
Figure 6:
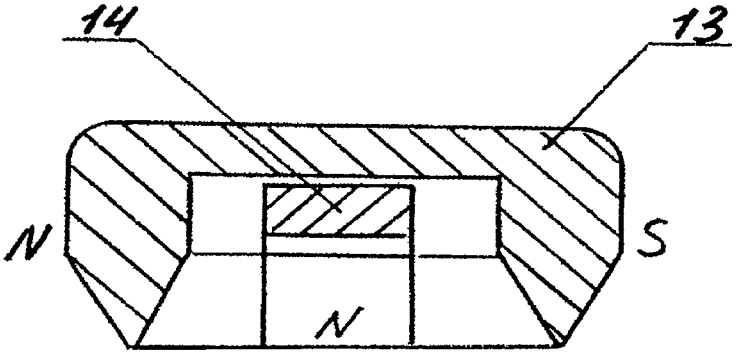
FIG. 6 is cross-section side view of said magnetic attachment base.
Figure 6A:
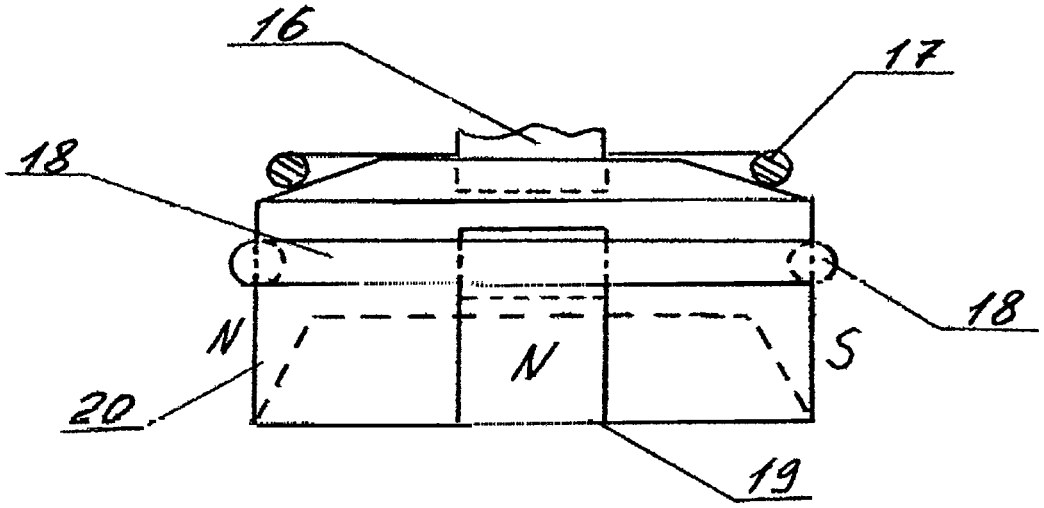
FIG. 6A is a side view of turnable magnet cover, matching base of FIG. 6
Figure 7:
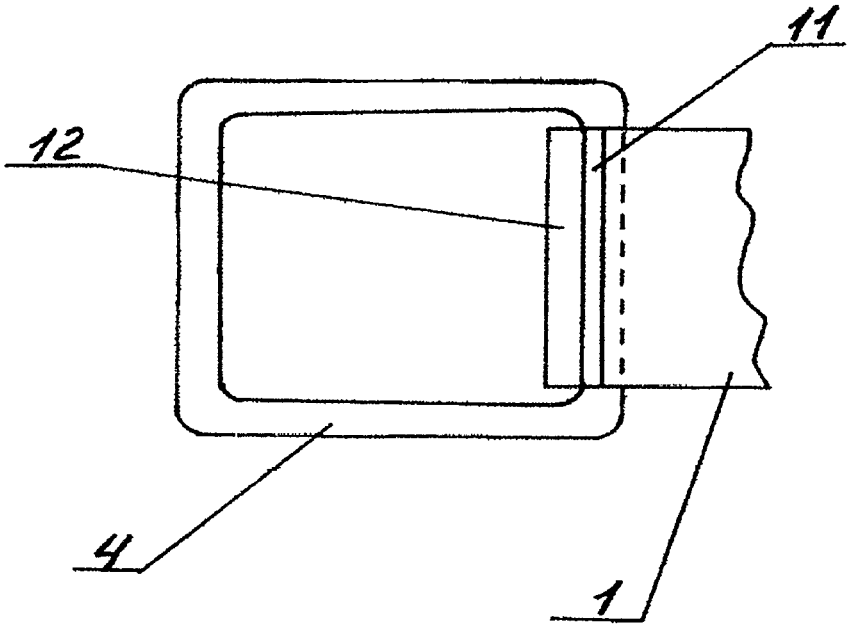
FIG. 7 is a strap buckle comprising piezo-luminescent coating.
Figure 8:
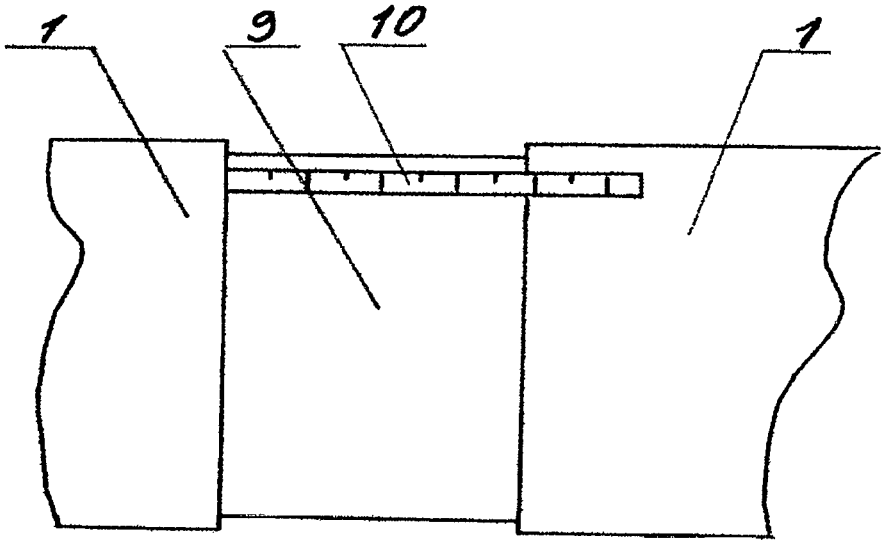
FIG. 8 is a view of elastic insert into the strap with an extension measuring strip.

First embodiment of this invention (FIG. 1) shows straps (1) going across the surfboard (2) or other type of board with the motor module (3), which comprises the built-in propeller and the air intake and exhaust tubing, shown underneath said surfboard (2). Said strap is made of a flexible and strong synthetic material, such as for example the kind of material that diving suits are made of and may include an underlayment of a flexible high friction material to assure that the strap with an attached motor module stays in place when said strap is properly tensioned. The strap may also feature a quick release locking mechanism such as a belt type buckle (4) which may have a second function as tightening means or for example a hinge-like connection wherein the rod may be pulled out by a string or other types of known quick release mechanisms. The strap may also comprise the tightening mechanism such as a ratchet (not shown) or a threaded strip in mesh with a screw or other known suitable for tightening mechanisms. In addition the strap may include a built-in device for measuring the tension force resulting from the tightening of the strap; such device (FIG. 7) may be piezo-luminescent coating emitting light (11) depending on the pressure applied, covered with a layer of sheer plastic (12), on a surface subjected to pressure due to the tension. Alternatively such a device (FIG. 8) may include an extendable elastic insert (9) into the strap whose width can be measured, for example by means of an affixed thereto measuring strip (10). This description shows only one cross-board strap used, but two or more such straps can be provided. There is a second version of this embodiment wherein the quick release attachment is provided not for the harness, but solely for the motor module which is to be released while the harness stays in place. The connection of motor module to the strap(s) can be implemented as a mechanical connection such as a hinge-type connection with removable rod, various male—female type connections with an inserted pin for securing them which can be quickly pulled out by a string thereby releasing the connection and a variety of other suitable known mechanical connectors and magnetic connections which will be of two general types. One type comprising at least one electric magnet preferably located on the motor module top and interacting either with at least one magnet or at least one piece of magnetically attractable material such as steel, iron, ferrite etc affixed on the strap(s). Another type (FIGS. 5 and 6) is based on at least one coupling made of permanent magnets wherein the base magnets are (13) located on the motor module and the opposite magnets (not shown) are mounted onto the strap. On FIG. 6A the opposite magnets axis (16) is affixed to the strap, the turn spring (17) urges the magnets to stay in the position of attraction while the string (18) is for turning the magnets (19 and 20) relative to magnets (13 and 14) from the position of attraction to the position of repulsion for quick release. On FIG. 4 motor module's (3) mounting is shown wherein either magnetic locks (22) or suction cups (22) are installed on bases (23). If suctions cups are used they will be provided with tubing connections to the air pump unit in the motor module (not shown).

Figure 3:
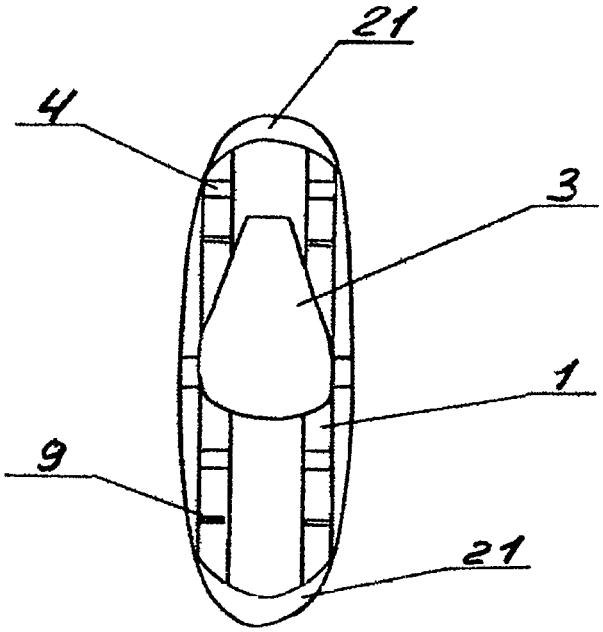
FIG. 3 is a bottom view of a surfboard with two board tip enclosures connected by longitudinal straps and one cross-board strap.

The second embodiment of the present invention (FIG. 3) comprises enclosures (21) made of the same or comparable material as the straps (1) for the front and rear ends of the board connected by longitudinal straps (1) either directly or to the motor (3) module at the rear and at the front respectively, as well as at least one cross-board strap (1) also connected to the motor; on the left and on the right, although it is possible to connect said cross board strap(s) to the longitudinal strap(s). The connection to the motor module can be implemented as described above for the first embodiment. Likewise the tightening means, the quick release means and the tension measuring devices will be as described for the first embodiment.

6. SKETCHES AND DIAGRAMS

Provided separately.

7. OPERATION

In operation the straps of the harness of the first embodiment will be placed onto the board and tightened by means of the tightening mechanism (FIG. 1) such as a belt buckle (4) or a ratchet to a predetermined level of tension which can optionally be measured either (FIG. 8) by the elongation of the extendable strip (9) which is an insert into the strap or by the emission of light by the piezo-luminescent coating as the strap's tension produces pressure on the thus coated part (11). Once the straps are installed, the motor module is mounted on them by either using the hinge-like attachments (not shown) which are aligned and then a rod is put through them or the magnetic attachments are used where the magnets on the motor module and the straps are aligned and if the magnets on the motor module are electric they are energized and if the permanent magnet based attachment is used then the magnets are turned into the attraction position. For the version of this embodiment where the motor module has suction cups said cups are firmly placed onto the board bottom or, if provided, a flat mounting plate attached to the straps and the air pump is operated to produce the required vacuum in said suction cups to assure the proper attachment of the motor module. When the surfer reaches his intended destination, by pulling a cord the release mechanism is actuated and the harness together with the attached thereto motor module is released from the board. With the hinge type lock once the rods are pulled by the cord(s) the heretofore connected parts become separated. With the electromagnetic lock once the electromagnet is de-energized the lock is released. With the permanent magnet lock once the magnets (19 and 20) are turned into a position of repulsion the lock is released. Subsequently the floating motor module together with the attached harness floats in the water and stays in waiting, with the motor stopped. If a signal is received from a control module the motor is activated and the motor module begins to travel homing in on the control signal transmitter which may be a different transmitter but with the same identifying security code. Thus one harness/motor module set can be used by a number of surfers awaiting their turn to use this equipment onshore. If no signal is given the motor module with the harness will be picked up.

For the second version of the first embodiment of the system of this invention only the motor module is released by the user reaching his destination while the harness stays in place on the board and then said motor module likewise can be activated by a radio signal to travel homing in on the transmitter of said signal while having flashing lights on or if no signal is given it will be picked up.

For the third version of this embodiment where the suction cups are used to attach the motor module, the air pump unit restarts its operation in reverse and pumps the air into suction cups thereby eliminating the vacuum there and assuring the motor module's quick release and then there are two possibilities: either it is released by itself while the harness stays in place or the harness is released together with the motor module. In both cases the motor module and its flashing lights can be activated by the radio signal and home in on its radio transmitter or arrive to a designated GPS (or other satellite positioning system) location or be picked up.

What is claimed is:

1. An attachment system suitable for use on swimming boards comprising: an adjustable board attachment harness, said harness including a tension measuring device; and a motor module affixable to the harness, where said tension measuring device is implemented as pressure sensitive paint operative to change color responsively to tension change within a strap part of the harness.

2. The system of claim 1, wherein said tension measuring device includes an elastic expandable element attached on two sides to the harness.

3. An attachment system suitable for use on swimming boards comprising:

an adjustable board attachment harness suitable for use on a variety of swimming boards; and a motor module affixable thereto, said motor module including a satellite based positioning control system for traveling by means of directing movement to a designated geoposition.

4. An attachment system suitable for use on swimming boards, the system comprising:

a strap harness releasably connectable to the swimming board;

a motor module connected to the strap harness;

a release mechanism operative to release, from the swimming board, the strap harness together with the motor module connected to the strap harness, said release mechanism including at least one electromagnet.

5. An attachment system suitable for use on swimming boards, the system comprising:

A strap harness releasably connectable to the swimming board;

a motor module connected to the strap harness;

a release mechanism operative to release, from the swimming board, the strap harness together with the motor module connected to the strap harness, said release mechanism comprising at least one magnetic lock having an interface of permanent magnets, wherein at least one of said magnets is rotatable relative to another.

6. An attachment system suitable for use on swimming boards, the system comprising:

a strap harness releasably connectable to the swimming board;

a motor module connected to the strap harness; and a release mechanism operative to release, from the swimming board, the strap harness together with the motor module connected to the strap harness, the harness comprising a front board tip enclosure and a rear board tip enclosure connected by at least one longitudinal strap.

7. An attachment system suitable for use on swimming boards, the system comprising:

a strap harness connected to the swimming board;

a motor module releasably connectable to the strap harness; and a release mechanism operative to release the motor module from the strap harness while the harness remains connected to the board, wherein the motor module includes a homing unit operative to drive the swimming board to a radio signal.

* * * * *